United States Patent [19]

Kasai et al.

[11] Patent Number: 4,583,866

[45] Date of Patent: Apr. 22, 1986

[54] WATCH DIAL AND METHOD FOR PREPARATION

[75] Inventors: Masami Kasai; Masao Kanai; Akira Okubo, all of Suwa, Japan

[73] Assignee: Kabushiki Kaisha Suwa Seikosha, Tokyo, Japan

[21] Appl. No.: 655,771

[22] Filed: Sep. 28, 1984

[30] Foreign Application Priority Data

Sep. 29, 1983 [JP] Japan ..... 58-181213
Apr. 16, 1984 [JP] Japan ..... 59-75994

[51] Int. Cl.[4] ..... B05D 3/06

[52] U.S. Cl. ..... 368/232; 427/54.1; 430/320; 430/327

[58] Field of Search ..... 368/232, 234–239; 430/320, 327; 427/54.1

[56] References Cited

U.S. PATENT DOCUMENTS 3,503,815 3/1970 Johnson ..... 430/320
3,989,603 11/1976 Montavon ..... 368/232
4,139,654 2/1979 Reed ..... 427/54.1
4,278,728 7/1981 Honda et al. ..... 427/54.1
4,306,013 12/1981 Roach et al. ..... 430/320
4,327,428 4/1982 Enomoto et al. ..... 368/232

FOREIGN PATENT DOCUMENTS 58953 5/1977 Japan ..... 368/232
110977 7/1982 Japan ..... 368/232

*Primary Examiner*—Bernard Roskoski
*Attorney, Agent, or Firm*—Blum Kaplan Friedman Silberman and Beran

[57] ABSTRACT

A watch dial is provided comprising a plastic or metal base plate. The base plate has thereon an uneven portion embodying a surface design, letter, window, symbol or mark. The uneven portion is formed by exposing photosensitive resin to ultraviolet light. The surface of the photosensitive resin portion of the base plate is metal-plated.

15 Claims, 21 Drawing Figures

FIG. 1A
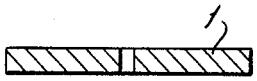
FIG. 1B
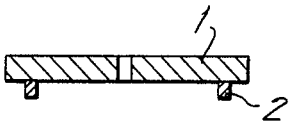
FIG. 1C
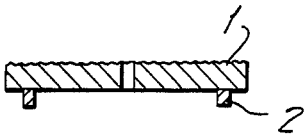
FIG. 1D
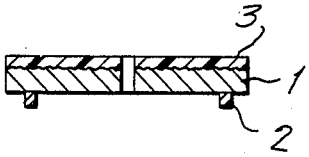
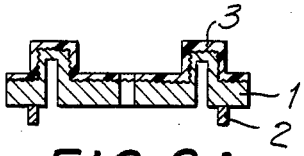
FIG. 2A
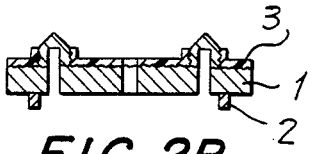
FIG. 2B
FIG. 3
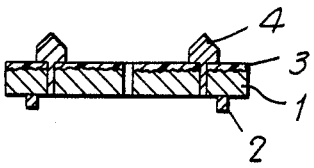

WATCH DIAL AND METHOD FOR PREPARATION

BACKGROUND OF THE INVENTION

This invention relates to a watch dial and, more particularly, to a watch dial having a photosensitive plastic layer upon which a surface design, letter, window, symbol, picture or mark is formed and which photosensitive layer has been metal plated, as well as a process for manufacturing such a watch dial.

Currently, there is a multitude of designs for watch dials and there is a great demand to produce many different designs in small quantities as speedily as possible. Because of such demand for so many kinds of watch dial designs, the cost of the production and manufacturing of each design has become of significant importance.

Generally, there are three types of metal-based watch dials made today, namely, (1) a printed metal-based dial which has been surface treated, coated and printed; (2) a metal-based dial on which letters, symbols or the like are formed by implanting them on the dial base, finishing with a surface treatment, and then coating and printing; and (3) dials made by coining in which a metal base finished with a surface treatment and coated is stamped using a coining method to obtain a raised symbol and thereby having the symbols and the dial base formed in one body. These three kinds of prior art manufacturing of dials are described below:

With respect to the printed dial, there are generally two (2) manufacturing methods: (1) the Butler-finishing method which presents a hairline design; and (2) a radial design method which utilizes a stamping or pressing process.

The Butler-finishing method starts with a nickel copper alloy base plate shown at FIG. 1-A as base plate 1. Then feet 2 are provided on the base plate 1. Two methods are presently used for providing feet on the base plate. The first method utilizes silver wax and in which feet 2 made of a copper pipe filled with silver wax are implanted in the base plate 1. The base plate and the feet are maintained at 800° C. for five (5) minutes in a furnace until the silver wax within the copper pipe melts and the feet are fixed on base 1. The disadvantage of this method is that the very high temperature (800° C.) for melting the silver wax causes the material of base 1 to become dull. In the case of a base made of brass, the hardness of the base before heating to 800° C. in the furnace is 180 Hv in Vickers hardness, whereas the hardness is reduced to 80 Hv after the base is maintained in a furnace. Therefore, one is limited in the thickness which may be used for the base plate and, in the case of brass, 30/100 mm is the thinnest base plate which may be practically used. A still further disadvantage of this method is that the high temperature requires a large and expensive furnace.

The second method for fixing the feet on the base is the use of resistance welding. By this method feet 2 having a sharpened end of dull copper are welded to the base 1 by applying electric current between the feet and the base while some pressure is subjected thereto. The principle of this method is that because of the resistance of the sharpended end portion of the feet is very large, the end portion is specially heated and the feet are fixed to the base. By this method, only the end portion of the feet 2 is heated and such a local heating does not effect the hardness of the base 1. However, this resistance welding methond has the disadvantage in that the feet and the base are subjected to pressure to ensure the stable fixation of the feet to the base, thereby causing the opposite side of the base to the feet to have projections as high as 10 to 20 mm. Thus, this method has the disadvantage that an additional process is required to remove the aforesaid projection on the base plate on the surface opposite the feet.

After fixing feet 2 on base 1 by either of the above two (2) methods in regard to the printed dial, the surface of the base plate is polished with a feather-cloth. If the polishing with the feather-cloth is incomplete and even if very small streaks are left on the surface, the appearance of the surface will be spoiled. Thus, the feature-cloth polishing process requires the skill of a highly-trained person. If there is a material fault in the base plate such as an impurity, it becomes nearly impossible to obtain a perfectly polished surface. Thus, the base plate must be made of a special metal including very little impurtities and must be carefully refined.

At this point the Butler design is provided on the polished surface of the base by a specific processing machine. Ten patterns of the Butler design are now available such as a radical design, a hairline design and the like and different processing machines are required for each design.

In FIG. 1-C the result of the providing a Butler design is shown. The surface is then honed by a specific honing machine and is followed by metal plating such as with nickel, silver or gold and such plating is then followed by the final step of spray coating 3 and printing as shown in FIG. 1-D.

The stamping method for manufacturing the printed dial begins with a press-cut base 1 which is annealed in order to facilitate the stamping process which is to follow. In accordance with this method, the design is provided on the surface of base 1 by the stamp process using a friction press of about 100 tons. Such friction press is a rather large and heavily equipped machine for the processing of a small dial. Following the stamping, a center hole is formed in base 1 by press-flanking. Feet are then provided by the above mentioned silver wax method. The resistance welding cannot be used since the surface of the base has already been stamped with a pattern and therefore it would not be feasible to remove projections which are formed in the course of the resistance welding method. Following the fixing of the feet, the base is plated, coated and printed in order to obtain the finished printed dial.

The second known process for manufacturing a watch dial involves an implanted dial. In this process, the base is prepared as above and the letters, marks, windows or the like are implanted in the base. Referring to FIG. 3 the letters 4 and marks to be implanted have feet 4*a* and corresponding holes must be provided on the base. If a window is to be implanted, the dial base is provided with an opening corresponding to the window. The implanted letters, marks, window or like are then fixed to the base plate by use of caulking together with an injected adhesive agent. Usually in this process there is as many as 11 or 12 implanted letters and thus the cost of the additional parts can be substantial. A further problem with the implanted method is that it involves many extra steps and is difficult to automate thus requiring many hand operations by a highly skilled worker.

The third known process for manufacturing a watch dial is the coining process and is described in reference to FIG. 2. In this process the base plate and feet are prepared as in the printed dial process and a design is printed, plated and coated on the base plate. In the coining method this is followed by the use of a press die to form raised letters as shown in FIG. 2-A. The raised letters are then finished by a diecut (FIG. 2-B) followed by printing and plating on the diecut surface. Thus the dial and letters are formed in one body and the coining process does not require the degree of skill as the other methods. However, the coining method has two (2) major disadvantages. First, the production of metal dies for the forming of the raised letters is expensive. This presents a particular problem when the number of dials to be produced is relatively small. The second disadvantage is that since the dial and the letters are formed in one body it is often too difficult, if not impossible, to diecut complicated designs.

SUMMARY OF THE INVENTION

Generally speaking, in accordance with the invention, an improved watch dial and process for manufacturing a watch dial is provided wherein the watch dial comprises a photosensitive plastic base plate having uneven portions which embody surface designs, letters, windows, symbols, pictures, marks or the like and which uneven portions are formed by hardening a layer of photosensitive resin on the base plate in a mold and/or by masking the photosensitive resin and exposing the unmasked portions to actinic radiation followed by the development or washing out of the unexposed resin. Following the formation of the uneven portions the surface of the photosensitive plastic base plate is then metal-plated.

Alternatively, a metal base plate can be substituted for the photosensitive plastic plate and a photosensitive plastic layer preferably at least 8/100 mm thick and having layer having such uneven portions is formed on the metal base plate. An adhesive agent can be provided between the metal base plate and the photosensitive plastic layer and is preferably a mixture of a hydrolytic silicon compound having an ethlyenically unsaturated substituent group, a hydrolitic tetralkoxy silane and a suitable catalyst such as tetraoctyl titanate and acidic water.

Preferably the metal-plating layer is comprised of three layers, a Ni group electrolytic plating layer, and electrolytic subplating layer and a finish plating layer, in that order. The Ni group electrolytic plating layer and the electrolytic subplating layer are preferably between 1,500 Å to 3,500 Å. It is still preferred that the electrolytic subplating layer is a single plating of an alloy of Ni, Co or Fe.

In accordance with the invention the color of the uneven portion emboding letter, windows, symbols, marks and a like and the color of the metal plating layer on the remaining portion of the photosensitive plastic layer may be different from each other.

Still further in accordance with the invention, a transparent protection layer no thicker than 800 Å may be super-imposed on the metal plating layer. Such transparent protective layer is preferably a film containing one hydrolytic silicon compound.

Still further in accordance with the invention, the uneven portions may be provided with a color or mat coating.

It is an object of the invention to provide an improved watch dial that can be easily manufacturer in small lots and eliminates the problems of conventional watch dials.

Another object of the invention in to reduce the cost of the manufacturing of watch dials.

The further object of the invention is to provide a watch dial which can be economically manufactured in a wide variety of designs.

A still further object of invention is to provide a watch dial that can be manufactured in a short time simpler equipment than that of the conventional machining processes for manufacturing a watch dial.

A further object of the invention, is to provide a process for manufacturing a watch dial utilizing a master resin mold from which a large number of resin molds can be produced.

Yet another object of the invention is to provide an improved watch dial in which a hardened photosensitive resin layer is adhered to a metal base plate layer.

A further object of the invention is to provide a watch dial with a molded photosensitive resin layer and a layer which has been developed following exposure to actinic radiation through a mask.

A still further object of the invention is to provide an improved watch dial in which a hardened photosensitive resin layer has been plated with a metal layer.

Still other objects and advantages of the invention will be obvious and will in part be apparent from the specification.

The invention accordingly comprises the features of construction, combinations of elements, and arrangements of parts together with the several steps and the relation of one or more of such steps with each other, and the scope of the invention will be indicated in the claims.

BRIEF DESCRIPTION OF THE DRAWINGS

For a fuller understanding of the invention, reference is made to the following description taken in connection with the accompanying drawing, in which:

FIGS. 1A–1D are a cross section of a watch dial manufactured in accordance with the coining method of the prior art.

FIGS. 2A–2B are a cross section of a watch dial manufactured in accordance with the prior art.

FIG. 3 is a cross section of a watch dial manufactured by implanting letters, symbols and the like in the watch dial according to the prior art.

DESCRIPTION OF THE PREFERRED EMBODIMENTS

Figure 4A:
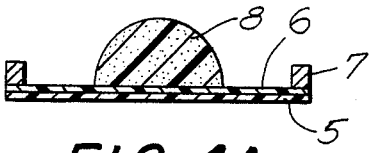
FIGS. 4A–4E are a cross section illustration of a watch dial made in accordance with one embodiment of the invention.
Figure 5A:
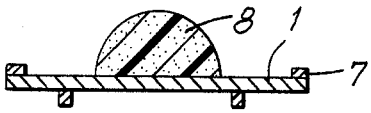
FIGS. 5A–5E are a cross section of another watch dial made in accordance with another embodiment of the invention.
Figure 4B:
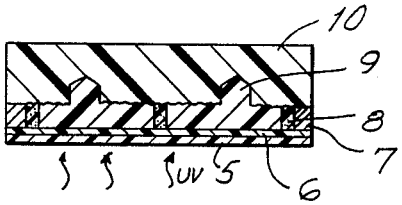
Figure 5B:
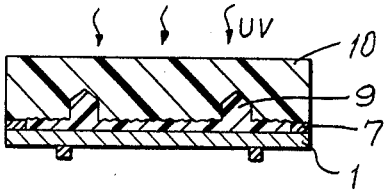
Figure 4C:
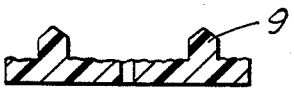
Figure 5C:
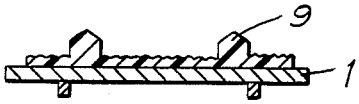
Figure 4D:
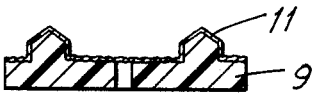
Figure 5D:
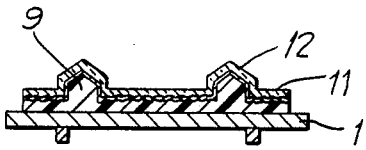
Figure 4E:
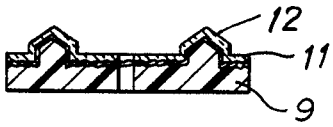
Figure 5E:
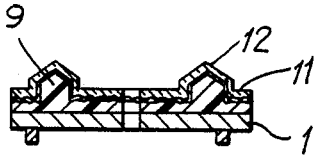

In FIG. 4, a watch dial manufactured in accordance with the instant invention is shown is cross section through the various stages of manufacture.

A polyethylene terepthalate film (PET) 6 is a put on mask 5 which has a transparent portion corresponding to the inside configuration of a dial and a darkened portion corresponding to the outside border of said dial. Spacer 7, having the thickness of the desired dial, is provided along the configuration of the transparent PET film 6. An appropriate amount of a photosensitive plastic monomer 8 (such as XFP 700 manufactured by Asahi Kasei Co., Ltd. which is a copolymer of acryl and ester) is dropped near the center of PET film 6 as shown as FIG. 4-A. It is important that the photosensitive monomer not form a foam and thus, it is desirable to perform a vacuum deaeration after dropping the monomer on the film if possible.

A resin mold of die 10 is set to sandwich the photosensitive monomer 8 with the PET film 6 as shown in FIG. 4-B. At this time, care must be taken to prevent air from entering between the PET film 6 and the plastic die 10. To ensure the shutting out of air, it is prefered to set the plastic die 10 in vacuum at $10^{-2}$ TORR.

Following the placing of the plastic die in a vacuum, ultraviolet radiation having a wave length of 350 to 400 nm is applied to the mask 5 to harden monomer 8 as shown in FIG. 2. The photosensitive monomer 8 is hardened by less than 5 seconds application of ultraviolet light of 150 mW.

The photosensitive resin 8 used in this embodiment is selected as one which is compatible with the plastic die 10 so that can be readily released from the die. In addition, the photosensitive plastic should have good adhesion properties with the metal layer which is to be provided on it and also exhibit corrosion resistance to any paint solvant which is to later be applied to the hardened resin.

Similarly, the material for the plastic die is selected regarding the ease of forming the plastic die, non-reactivity to the photosensitive resin 8, and releaseability from the hardened photosensitive plastic resin. Additionally, if, as in a different embodiment, the ultraviolet light is to be applied through the plastic die, the die is required to have properties which will allow the transmittance of ultraviolet radiation having a wave length of 350 to 400 nm.

Figure 7A:
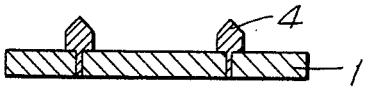
FIGS. 7A–7C is a cross section illustrating a method for manufacturing a plastic mother mold.
Figure 7B:
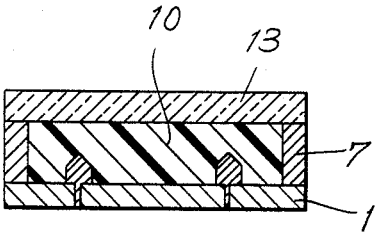
Figure 7C:
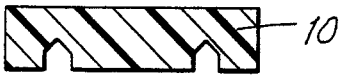

In accordance with the invention, first the metal master of FIG. 7-A, having implanted letters 4 is formed. This metal master is equivalent to the desired watch dial. Spacers 7 are placed on metal master 1 and casting resin such as CR-39 (which is a diethyleneglycol bisallylcarbonate) is injected in the space formed by the metal master, spacer 7 and a glass plate 13. The casting resin is then hardened by a thermal ploymerization as shown in FIG. 7-B. After the plastic monomer is hardened, the metal master and glass and spacers are removed in order to obtain the plastic mother shown in FIG. 7-C. The metal master may be used repeatedly, allowing many plastic mothers to be made with one master.

Beside CR-39, casting type acrylic plastic, transparent silicon rubber plastic for casting and the like may also, be used as the material for the plastic mother 10 of the invention.

Returning to embodiment of FIG. 4, after the monomer has been exposed through the mask the hardened photosensitive plastic dial is released from the plastic mother 10 and the photosensitive plastic monomer which remains unhardened is removed by washing with a compatable developer preferably boric acid soda or sodium carbonate. The resulting dial is shown in FIG. 4-C.

The surface of the hardened photosensitive plastic on which the design is transferred from the plastic mother is metalized with a thin layer 11 as shown in FIG. 4-D. This metalization can be done by either wet or dry plating. For dry plating the deposition or sputtering methods are suitable. For wet plating, it is preferred that "electroless" Ni be used in order to give a superior appearance and adhesiveness between the plating layer and the photosensitive plastic.

Before plating, it is preferred to prepare the surface by dipping the surface into a 1% HCl acid 1% tin chloride solution for one about one minute at room temperature, washing with water for one minute, then dipping the surface into a paladium chloride solution (density: 5 to 10%, preferably 8%) for one minute, and washing with water for one minute followed by drying.

After the surface preparation, the photosensitive plastic is plated by dipping into an electroless Ni-P alloy having a 2–10% P, such as S-680 by Cannizen Co., at about 50° for about one minute. This formed Ni-P layer preferably comprises about 8% P and is as thick as approximately 500 Å. It is prefered that Ni-P plating layer be as thin a possible since the thinner the layer the better the adhesion to the photosensitive plastic.

In addition to the electroless Ni-P alloy plate, an Ni-B alloy plate having 2–5% B, or Ni alloys with cobalt and tungsten, phosphorous and tungsten or boron and tungsten or the like.

The surface is then subplated with an electolytic Ni-series material. Such subplating is followed by a finish plating with a material usually selected from silver, gold, black nickel or a like. The subplating is necessary for the finish plating because of some problems with respect to throwing power, making it almost impossible to provide the finish plating directly on the electoless Ni plating. These problems appear to arise since the Ni-P alloy has a extremely high resistivity and that the electoless Ni-P plate is very thin. This problem is even greater when the finishing material is Ag. Therefore, the electrolytic Ni-series subplating is applied to reduce the resistivity of the Ni-P alloy and should also be selected so that it will be unlikely to thermally diffuse into the finish plating. Thus, for example, in the case where the finish plating is Ag, the subplating should not contain Cu, since Cu diffuses into a discoloring of Ag plating.

It is preferred to use a wet bathing for the electrolytic Ni-series plating. The following are constituents for the electroytic plating:

nickel sulfate hexahydrosalt 225 g/l
nickel chloride hexahydrosalt 40 g/l
boric acid 25 g/l
glass agent 5 g/l
pH 4.3
fluid temperature 50° C.
electric current density 1 A/dm$^2$ In accordance with the above conditions, the electrolytic Ni-series plating is provided so that the thickness of the plating layer including the electrolytic Ni-series plating and the "electroless" Ni-P plating is between 1,500 Å and 3,500 Å. The highest and the lowest of the above range are defined with respect to the adhesion between the photosensitive plastic and the metal film and the throwing power of the finishing plating, respectively.

In the above description, the electrolytic Ni-plating is referred to as an example. However, a single metal plating or an alloy plating of Co or Fe may also be used as the subplating. Further examples of alloy plating are Ni-Co plating, Fe-Ni plating, Ni-Pd plating and the like.

After the electrolytic Ni-series plating, the finishing plating is provided thereon. The material of the finishing plating is usually selected from Ag, Au, black nickel and the like and the thickness thereof is preferably approximately 500 Å which allows the color tone to appear effectively (FIG. 4-D). In FIG. 4-D, the plating layer 11 includes the three layers of electroless Ni deposition, Ni subplating and the finishing plating.

Finally, painting and printing are provided and thus a finished watch dial is obtained (FIG. 4-E).

Beside the wet plating process described above a deposition process can be employed as a dry plating process. In particular, a low-temperature sputtering process is the most suitable for metallizing the surface of resin. For instance, in case of Au-colored metallizing process, Ni of 1000 Å is sputtered by a low-temperature sputtering apparatus, and then Au of 500 Å through 1000 Å is sputtered, so that the desired gilt color can be obtained depending on the thickness of Au.

After metallizing, the resin is coated, printed and punched out, which results in a printing-type dial provided with the surface design in accordance with the manufacturing process of present invention.

Figure 6:
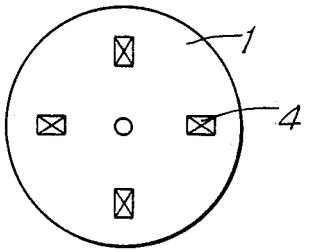
FIG. 6 is a plan view of a watch dial made in accordance with the invention.

FIG. 6 is a plan view of the watch dial of this embodiment showing letters or numerials 4 on base plate 1.

An another embodiment of the instant invention is described in detail with reference to FIG. 5.

First, the base plate 1 is formed by punching out a steel material as thick as 20/100 mm. In general, the available material for the base plate 1 is the nickel-copper alloy or brass whose quality is specially adjusted to reduce the material defects. In accordance with this invention, however, it is not necessary to select the well-adjusted material for the base 1. Consequently, the material cost can be largely reduced. For example, if the steel is used, the material cost is less than one-fourth of the case where the nickel-copper alloy is used.

Then, the feet 2 are fixed to the base 1 by the resistance welding method. At this time, the obverse of the base 1 where the feet 2 are fixed is transformed, that is, a projection as high as 1/100 to 2/100 mm is produced. However, the projections do not raise any problem if the thickness of the photosensitive plastic layer 9 which is to be formed in the observe of the base 1 later is more than claim 8/100 mm. Accordingly, in this invention, it is not necessary to remove the projection of the obverse of the base produced by the welding which is necessary in the conventional method.

Next, an adhesive agent is applied on the opposite side of the base plate 1 to improve the adhesion between the base and the photosensitive plastic curing layer which is formed in the next process. The preferred adhesive agent is the isopropylalcohol solution containing 2 wt % of methacryloxy propyl tremethoxy silane, 2 wt % of tetramethoxy silane and 1 wt % of tetrakis (2-ethylhexoxy) titanium. The adhesive agent as above is sprayed over the opposite side of the base and is heated at the temperature of about 150° C. for one hour to make a film of the adhesive agent so that the film is secured to said side of the base. In order to improve the adhesion therebetween, it is effective to rough the obverse of the base by satin finish, for example. The thickness of the adhesive agent is about 500 Å.

One of the constituents of the adhesive agent, γ-methacryloxy propyl tremethoxy silane

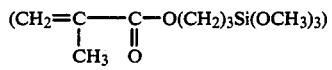

functions to bond the adhesive agent to the photosensitive plastic. To be more concrete, γ-methacryloxy propyl trimethoxy silane is a hydrolytic silicon compound having an ethylenically unsaturated substitute group and the unsaturated group bonds chemically with the photosensitive monomer by light reaction and the strong adhesion therebetween is achieved. Besides r-methacryloxy propyl trimethoxy silane, another hydrolytic compound having an ethylenically unsaturated substitute group such as vinyl trimethoxy silane $$(CH_2{=}CH\text{-}Si(OC_2H_5)_3)$$

may be used.

The other constituent of the adhesive agent, tetramethoxy silane has a function to bond the adhesive agent to the metal base. For that purpose, another tetraalkoxy silane compound such as tetraethoxy silane or tetrapentaoxy silane may be used.

The tetraoctyloxy titan acts as a catalyst by means of hydrolysis of the hydrolytic compound having an ethlenically unsaturated substituent group and tetralkoxy silane compound. For such a catalytic function as above, tetraalkoxy titan compound such as tetrabutoxy titan or tetrahexyloxy titan besides tetraoctyloxy titan, and acidic water such as HCl, and the mixture solution of acidic water and organic catalysts such as alcohol, ketone or esther may be used.

On the adhesive agent coated surface of the base plate 1, and appropriate amount of a photosensitive plastic monomer (such as XFP 700 8 by Asahi Kasei Co., Ltd.) is dropped (FIG. 5-A). The photosensitive plastic monomer 8 dropped on the base 1 should be degassed preferably by the vacuum deaeration with the degree of vacuum being $10^{-2}$ TORR.

Next, plastic mother 10 having the desired under-surface design and depressed figures is pressed on the photosensitive plastic monomer 8 so that the plastic mother 10 and the base plate 1 sandwich the photosensitive plastic monomer 8, keeping the thickness thereof to about 10/100 mm. At this time, in order to prevent the air from entering between the base plate 1 and the plastic mother 10, the vacuum deaeration as above is performed.

Ultraviolet radiation (UV) having the wave length of 350 to 400 nm is then applied on the upper surface of the plastic mother 10 to cure the photosensitive plastic monomer. The strength of the ultraviolet radiation is 150 mW and the application thereof is less than 5 seconds (FIG. 5-B). At the time when the photosensitive plastic is cured, the photosensitive plastic chemically bonds to the adhesive agent and consequently the photosensitive plastic layer bonds to the base plate through the intermediary of the adhesive agent.

The photosensitive plastic 8, should have the same qualities as that of the embodiment shown in FIG. 4 and previously described.

The material of the plastic mother 10 is required to have a good transmittance of the ultraviolet ray of the wave length of 350 to 400 nm in addition to the necessary properties of the embodiment of FIG. 4 so that the curing of the photosensitive plastic monomer 8 is achieved by applying the ultraviolet radiation through the plastic mother 10. In this embodiment, besides CR-39, casting acrylic resin, transparent silicon rubber resin and the like may also be used.

After curing the photosensitive plastic, the plastic mother 10 is removed and an equivalent to the master in which the photosensitive plastic 9 having the obverse to which the design of the plastic mother 10 is transfered is formed on the base plate 1 (FIG. 5-C). The thickness of the photosensitive plastic 9 is from 8/100 mm to 5 mm and preferably is about 10/100 mm. Herein, it should be noted that the thickness of the photosensitive plastic 9 has a great effect on the metal film which is to be formed thereon in the later process. That is, if the thickness is less than 8/100 mm, the metal film partially blisters and also the quality of the metal material is deteriorated in durability even if the material is satisfactory at first. For example, when the thermal impulse higher than 100° C. is substituted, the metal film partially blisters. If the thickness of the photosensitive plastic is more than 8/100 mm, the blistering of the metal film is avoided.

The table below shows the result of an experiment on the correlation of the thickness of the photosensitive plastic and the incidence of the blister of metal film. The material includes the electroless Ni deposition as thick as 500 Å, the electrolytic Ni subplating as thick as 2,000 Å, the finish Ag plating as thick as 500 Å and the coating layer as thick as 500 Å.

| Time When Blister Occurs/Thickness | Finished Article | Thermal Impulse |
|---|---|---|
| 5/100 mm | 50% | 70% |
| 8/100 | 0 | 0 |
| 20/100 | 0 | 0 |

In the above table, the columns of the "finished article" and "thermal impulse" show the incidence of the blister of the metal film at the time when the finished watch dial is obtained and after the finished article is maintained at the temperature of 150° C. for 30 minutes.

After hardened, the surface with transferred design is metalized as follows.

First, a surface treatment to provide the catalytic nucleus for the electroless Ni deposition by using the surface treatment solution by Hitachi Kasei Co. as follows: the material is immersed in HCl (20% solution) for the first 2 minutes at room temperature, then in the sensitizing agent (HS-101B) for the next 5 minutes at room temperature, following washing with water for two minutes the material is dipped in adhesion accelerator (ADP-201) for the last 3 minutes at room temperature and washed with water again for one minute. The sensitizing agent is made by placing Pd colloid whose surface is covered with Sn into 30% HCl acid solution. The Pd acts as a catalytic nucleus for electroless Ni plating that follows. The accelerator is 15–25% aqueous sulfuric acid and acts for dissolving the Pd catalytic nucleus Sn attached in the sensitizing treatment in order to activate the catalytic nucleus.

After the above surface treatment, the material is dipped into the electoless Ni-P alloy (S-680 by Cannizen Co.) at the temperature of 50° C. for 1 minute. By dipping as above, Ni-P (the content of P is 8 wt %) layer is obtained as thick as about 500 Å.

Then, the electrolytic Ni plating is superimposed on the electroless Ni-P layer as thick as 2,000 Å by using the same plating solution under the same conditions as described in the embodiment of FIG. 4.

On the electrolytic plating, the finish plating of Ag is deposited as thick as 500 Å (FIG. 5-D). In FIG. 5-D, the plating layer 11 consists of three layers; the electroless Ni plating, the Ni subplating and the finish plating of Ag.

On the very top of thus formed three plating layers, the transparent protective layer 12 is formed by spraying isopropyl alcohol solution containing 2 wt % of the tetramethoxy silane and 1 wt % of tetraoctyl titanate and by heating at the temperature of 150° C. for 15 minutes. By the above operation, the transparent protective layer as thick as 300 to 500 Å is formed. This protective layer is so thin that it does not affect the appearance of the finished dial. Also, the protective layer which is very dense function to prevent the discoloring of the finish plating layer.

The tetrametoxy silane in the above solution is a hydrolytic organic silicon compound and contributes to making the dense film by being hydrolyzed with the catalyst of tetraoctyl titanate. Other hydrolytic organic silicon compounds other than tetrametoxy silane may also be used.

Usually, in forming the protective layer to prevent the chemical discoloring of the finishing plating, there is a problem that the protective layer may affect the appearance of the finished dial. In this embodiment of the present invention, if the protective layer is much thicker than 1 μm, the thickness of the layer becomes uneven on and around the letters, especially at the convex or concave corner of the indicators, and consequently the appearance of the dial is deteriorated. If the protective layer is much thinner than 1 μm, the unevenness of the thickness is eliminated but the interference color appears. Accordingly, the protective layer should be thinner than 800 Å which thickness is free from the interference color and still functions to prevent the discoloring of the finish plating. The plastic protective layer used in the conventional watch dial loses the function to prevent the discoloring when the layer is thinner than 800 Å.

After forming the protective layer the minute scales and so on are printed thereon.

Finally, the configuration of the dial and the center hole are punched out and the watch dial of this embodiment is obtained (FIG. 5-E).

The description so far relates to a watch dial and the method for preparing a watch dial in which the surface of the base and the letters are of the same color. The method for preparing the same in which the color of the base and letters is different is described below.

The same processes as in the above description are followed as far as the electrolytic Ni plating is completed. Before the finish plating, Au plating of the color of the letters is deposited on the electrolytic Ni plating layer. Then the portion to be become letters is covered by resists. In order to provide resist partially, the screen printing method as an example, is employed. Next, Ag plating of the color of the base is deposited.

After chemically separating the resists, the watch dial in which the letters are of the color of Au and the designed base plate is of the color of Ag is obtained.

The following is a description of the process for manufacturing a watch dial in which a mat coating or a color coating is provided on the dial with the exception of the letters.

After the finish plating and the transparent protective layer is formed by following the same process as in the embodiment of FIG. 5, the letters are coated by the resists. Then, the desired mat coating or the color coating is spread over the whole surface of the watch dial.

By chemically separating the resists by dissolving, the mat cating or the color coating on the resists are removed and the watch dial in which the part other than the uneven portions such as letters or marks are provided with the mat coating or the color coating is obtained. Thus the finished watch dial is proved to be free from the deterioration in quality as substantiated by tests including the thermal impulse test (150° C. for 30 minutes), the thermal cycle test (repetition of 60° C. for 30 minutes and −20° C. for 30 minutes) and the fademeter test (wet atmosphere 200H). Accordingly, the watch dial in accordance with this invention is equivalent to the conventional dials in the quality of appearance and functional.

It can thus be seen that in accordance with the instant invention, designs of the watch dials can be easily varied by utilizing a master mold to make a plurality of plastic mold mothers, the cost of making the master is relatively insignificant. So further, the invention provides means for making designs which might be impossible to obtain by using the prior art processes due to their inherent limitations.

It will thus be seen that the objects set forth above, among those made apparent from the proceeding description are efficiently attained and, since certain changes may be made in carrying out the above process and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features herein described, and all statements of the scope of the invention which as a matter of language might be said to fall therebetween.

What is claimed is:

1. A watch dial comprising:
a metal base plate,
an adhesive agent comprising a mixture of hydrolytic silicon compound having an ethylenically unsaturated substituent group, hydrolytic tetra-alkoxy silane and a suitable catalytic component,
a hardened photosensitive plastic layer having uneven portions thereon embodying a surface design, letter, window, symbol, picture, or mark, said layer being on said adhesive agent, said uneven portions being formed by photopolymerization, and
a metal plating layer on the surface of said photosensitive plastic layer.

2. The watch dial of claim 1, in which the catalytic component comprises tetrakis (2-ethylhexoxy) titanium and acidic water.

3. The watch dial of claim 1, in which the thickness of said photosensitive plastic layer is 8/100 mm or greater.

4. A watch dial of claim 1, in which said metal plating layer includes an Ni group electroless plating first layer, an electrolytic subplating second layer and a finish plating third layer, said three plating layers being in said order, and the thickness of the Ni group electroless plating layer and the electrolytic subplating layer together is in the range between 1,500 Å to 3,500 Å.

5. A watch dial of claim 4, in which said electrolytic subplating layer is one of a single plating and comprises an alloy plating of Ni, Co or Fe.

6. A watch dial of claim 1, in which the color of said uneven portions and the color of the metal plating layer on the remaining portion of said photosensitive plastic layer are different from each other.

7. A watch dial of claim 1, in which a transparent protective layer not thicker than 800 Å is superimposed on said metal plating layer.

8. A watch dial of claim 7, in which said transparent protective layer is a film comprising at least one hydrolytic silicon compound.

9. A watch dial of claim 1, in which the parts other than the uneven portions are provided with a color or mat coating.

10. A process for manufacturing a watch dial comprising:
applying a photosensitive resin to a base plate,
pressing said resin between a mold and said base plate, said mold being capable of transmitting ultraviolet radiation,
exposing said photosensitive resin to ultraviolet radiation applied through the mold in order to harden the said resin,
applying an adhesive agent comprising a mixture of a hydrolytic silicon compound having an ethylenically unsaturated substituent group, hydrolytic tetra-alkoxy silane and a suitable catalyst on the hardened photosensitive plastic resin, and
removing the mold and depositing a metal plating layer on the hardened photosensitive plastic resin.

11. A process of claim 10, wherein said catalyst comprises tetrakis (2-ethylhexoxy) titanium and acidic water.

12. The process of claim 10, wherein said metal plating comprises the sequential plating of a nickel group electroless plating layer, an electrolytic subplating layer and a finished plating layer, with the thickness of the nickel group electroless plating layer and the electrolytic subplating layer together being from 1,500 Å to 3,500 Å.

13. The process of claim 12, in which said electrolytic subplating layer is a single plating and comprises an alloy plating of nickel cobalt or iron.

14. The process of claim 10, further comprising attaching feet to said base plate by resistance welding.

15. A watch dial comprising:
a base plate;
an adhesive agent comprising a mixture of hydrolytic silicon compound having an ethylenically unsaturated substituent group, hydrolytic tetra-alkoxy silane and a suitable catalytic component,
a hardened photosensitive plastic layer having uneven portions thereon embodying a surface design, letter, window, symbol, picture or mark, said layer on said adhesive agent, said uneven portions being formed by photopolymerization; and
a metal plating layer on at the surface of said photosensitive plastic layer.

* * * * *